US006589113B2

(12) United States Patent
Sells

(10) Patent No.: US 6,589,113 B2
(45) Date of Patent: Jul. 8, 2003

(54) VENT CLOSURE MEMBER WITH LIFT SPACER

(75) Inventor: Gary L. Sells, Mishawaka, IN (US)

(73) Assignee: Cor-A-Vent, Inc., Mishawaka, IN (US)

( * ) Notice: Subject to any disclaimer, the term of this patent is extended or adjusted under 35 U.S.C. 154(b) by 0 days.

(21) Appl. No.: 10/033,198

(22) Filed: Dec. 28, 2001

(65) Prior Publication Data

US 2002/0086634 A1 Jul. 4, 2002

Related U.S. Application Data

(60) Provisional application No. 60/258,987, filed on Dec. 29, 2000.

(51) Int. Cl.[7] ..... F24F 7/02

(52) U.S. Cl. ..... 454/365; 137/521; 454/259; 454/359

(58) Field of Search ..... 454/259, 353, 454/359, 358, 364, 365, 361, 363; 52/199; 137/517, 519, 521, 852, 527, 855

(56) References Cited

U.S. PATENT DOCUMENTS 1,635,842 A * 7/1927 Hirshstein ..... 137/519
3,949,657 A 4/1976 Sells
4,407,613 A * 10/1983 Jones ..... 137/112
5,921,863 A 7/1999 Sells
5,992,451 A * 11/1999 Chang ..... 137/518
6,213,868 B1 4/2001 Sells
2001/0003703 A1 6/2001 Sells

* cited by examiner

*Primary Examiner*—Harold Joyce
(74) *Attorney, Agent, or Firm*—Baker & Daniels

(57) ABSTRACT

A ridge vent assembly extends along a roof ridge of a building. One embodiment has corrugated plies defining small diameter passages that communicate a vent opening cut along the ridge of the roof with ambient atmosphere. A moveable valve member extends along the outer edge of the vent parts and includes a lift spacer to keep the valve member spaced from the roof when in an inactive position. When wind speed increases above a predetermined wind speed, the movable member moves into a position adjoining the edge of the vent parts and the bubble is compressed against the upper edge of the corresponding vent part, thereby preventing entry of wind driven moisture and snow into the passages and into the building structure through the vent opening. Accordingly, the moveable valve member acts as a weatherstripping material for the vent. A similar flexible member is usable to weatherstrip windows, doors, and other building openings.

18 Claims, 6 Drawing Sheets

VENT CLOSURE MEMBER WITH LIFT SPACER

BACKGROUND OF THE INVENTION

This invention relates to a roof ventilating device which is provided with a movable member that prevents wind driven snow or rain from entering the building.

DISCUSSION OF THE PRIOR ART

Roof ventilators have been used to prevent dangerous heat build-up in the attics or upper floors of houses and other structures. One such roof ventilator is disclosed in U.S. Pat. No. 3,949,657 incorporated herein by reference. The roof ventilators disclosed in this patent provide a cover for an elongated opening cut along the ridge of a roof. The ventilating device covers the opening, and provides relatively narrow passages to vent heat from the interior of the structure. The passages are designed to be small enough so that entry of moisture is restricted. However, during storms, wind driven rain or snow could be forced into the roof opening through the passages if the wind is strong enough.

According to prior U.S. Pat. No. 5,921,863, incorporated herein by reference, a movable member has a pressure-responsive surface that responds to ambient winds speeds in excess of a predetermined level to move into a closed position closing the passages. Accordingly, entry of moisture into the structure is restricted. The movable member in this prior application is relatively inflexible. Furthermore, it has been learned that under certain atmospheric conditions, wind speed across the tip of the baffle and the top of the ventilating device can act to partially open the baffle even after it has been closed, thereby permitting moisture to enter the structure.

Other pressure-responsive moveable members are shown in U.S. Pat. No. 6,213,868 and U.S. patent application Ser. No. 09,727,720 by Applicant, both incorporated herein by reference.

One of the prior art roof ventilating devices is shown in FIGS. 1, 1A, 2, 3, 4, and 5. A roof ventilating device is shown generally by the numeral 10 and is installed on the ridge of a roof generally indicated by the numeral 12. Roof 12 includes a longitudinally extending ridge member 14 and transversely spaced rafters 16 which are covered by underlayment or sheathing generally indicated by the numeral 18. A portion of the sheathing or underlayment 18 adjacent the ridge board 14 is cut away to define a longitudinally extending vent opening 20 (FIG. 3). Shingles 22 are applied to the sheathing or underlayment 18 to complete the roof.

The ventilating device 10 includes a pair of vent parts 26 that are connected by a connecting portion 28. Each of the vent parts 26 extend along opposite sides of the ridge board 14 and provide a cap or cover extending over the vent openings 20. As more clearly described in the aforementioned U.S. Pat. No. 3,949,657, (the entirety of which is incorporated herein by reference) the vent parts 26 each include several courses or plies of a corrugated material manufactured of a waterproof or weatherproof construction, such as plastic box stock. Plies are generally indicated by the numeral 30. Accordingly, each of the plies 30 consists of generally parallel passages 32 provided by the box stock corrugations each of which provide a small diameter passage for communicating the vent openings 20 with ambient atmosphere. The ends of the passages 32 define an inner edge 34 of the vent part 26 which extends over the vent openings 20, and the outer ends of the passages 32 define an outer edge 36. The ventilating device 10 is installed on the roof 12 by appropriate fasteners (not shown), such as roofing nails driven through each of the vent parts 26 at appropriate intervals along the length of the ventilating device.

According to the invention, a flexible baffle generally indicated by the numeral 38 consists of a strip of cloth that extends along the outer edge 36 of each vent part 26. In the embodiment of FIGS. 1–5, the member 38 is constructed of TYPAR® Barn Construction Fabric, Part No. 3304T-002, available from Reemay, Inc., Old Hickory, Tenn. TYPAR® barn construction fabric consists of a one or more layers of spunbonded olefin sheets, as indicated at 39 of high-density polyethelene fibers, available from DuPont, Inc., as "Tyvek®", which has been coated with a polymer coating 41 available from Techmer Corp., Knoxville, Tenn., sold as PM-9098E4. The barn construction fabric was selected because of its durability, in that roofs are commonly replaced only after 20–25 years, and the TYPAR barn construction fabric has the necessary durability. Other fabrics, such as canvas, may be used, but may have be replaced at shorter intervals. The ventilating device 10 also includes an opposite upper surface 44, which is normally covered by shingles 46.

The baffle 38 includes an inner edge 40 (FIGS. 1 and 4) which is secured to the lower surface 42 (FIG. 3) of the ventilating device 10, which is applied directly to the roof 12. The ventilating device 10 also includes an opposite upper surface 44, which is normally covered by shingles 46. The movable member 38 is secured to the lower surface by a longitudinally extending sonic weld or impulse bond 48. The impulse bond 48 is formed in a conventional manner by bringing the welding head against the baffle 38 and compressing it against the vent part 26, heating the head, cooling the head, and then withdrawing the head. The head is heated for only a very brief time necessary to effect the weld, since the fabric or the cloth strip from which the baffle is made is relatively thin and appreciable heating would burn through the baffle. The outer end 50 (FIG. 4) of this movable member 38 is looped around and sealed to the flexible member by sonic welding or an impulse seal 52, which is formed in the same way as the impulse seal described above which attaches the baffle 38 to the corresponding vent part 26. Accordingly, an enclosed compartment is formed defining a compressible bubble 54. Of course, the movable member 38 may also be used without the bubble if desired, but as discussed above, the bubble 54 provides additional sealing when the movable member 38 is in the closed position.

As illustrated in FIG. 1, the member 38 may be divided into sections by kerfs 57 cut transversely across the strip, thereby permitting each individual section of the movable member to respond individually to ambient wind conditions. Of course, if a continuous and uninterrupted strip is provided, the strip opens and closes as a unit. In addition to kerfs 57, the movable member may also include slits 59 as shown in FIG. 1A to increase the flexibility of the member and provide a tighter fit against vent part 26 when closed. The slits may extend transversely across the bubble 54 to seal 52 or the slits may extend across only a portion of the bubble. These slits may also extend beyond seal 52, but this may result in tearing of the baffle under high wind conditions. The flexible member may contain both kerfs 47 and slits 59 or only one or the other.

When ambient wind conditions are low, the movable member 38 rests on the shingles 22, thereby opening the passages 32 to permit venting of air from the attic or upper story of the structure covered by the roof through the vent opening 20 and the passages 32. However, when ambient speeds increases to a predetermined wind speed, the movable member 38 responds to the wind, it being noted that the bubble 54 forms a lip which is caught by the wind, which forces the movable member to the closed position illustrated in FIG. 3. The width of the movable member 38 is such that the bubble 54 engages the corner 56 between the outer edge 36 and the upper surface 44 of the vent parts 26. Increasing wind speed thereafter compresses the bubble 54 against the corner 56, it being noted that the width of the movable member 38 is such that the bubble extends above the surface 54 a small distance. Because of the compression of the bubble 54 against the corner 56, a seal restraining entry of wind driven moisture and snow is provided, and the movable member 38 cannot be forced away from the edge 36 by aerodynamic conditions, as was the case in the prior art devices.

SUMMARY OF THE INVENTION

The present invention provides a movable member made out of cloth, which is relatively flexible and thus is able to close against the outer edge of the ventilating device more easily than the relatively stiff movable member disclosed in my prior application. Furthermore, the upper edge of the present invention terminates in a flexible cavity or "bubble" that extends longitudinally along the edge of the movable member. During storms, the movable member first moves into a position to close the vent openings, and the bubble is thereafter deformed against the upper edge of the ventilating device, thus providing a seal to assure that snow and moisture will not enter the vent passages. A lift spacer is provided on the movable member to provide a slight separation between the movable member and the roof while the movable member is an open position allowing air to vent through the vent openings. As wind speed increases, the lift spacer aids to allow air to pass beneath the movable member to facilitate the movable member moving into the closed position. The lift spacer also helps to prevent the movable member from becoming frozen to the roof in cold weather. The movable member acts as weather stripping that seals against the ventilating device in response to wind speed. Accordingly, the present invention of an elongated strip of cloth material having a bubble extending along one edge thereof may also be used as weather stripping around the edges of doors and windows. Furthermore, the deformable bubble may be used in other types of ventilating device according to other embodiments of the invention, in which a flexible bubble is mounted on relatively stiff baffles used in other types of ventilators.

These and other advantages of the present invention will become apparent from the following description, with reference to the accompanying drawings.

DETAILED DESCRIPTION OF THE PREFERRED EMBODIMENT

Figure 1:
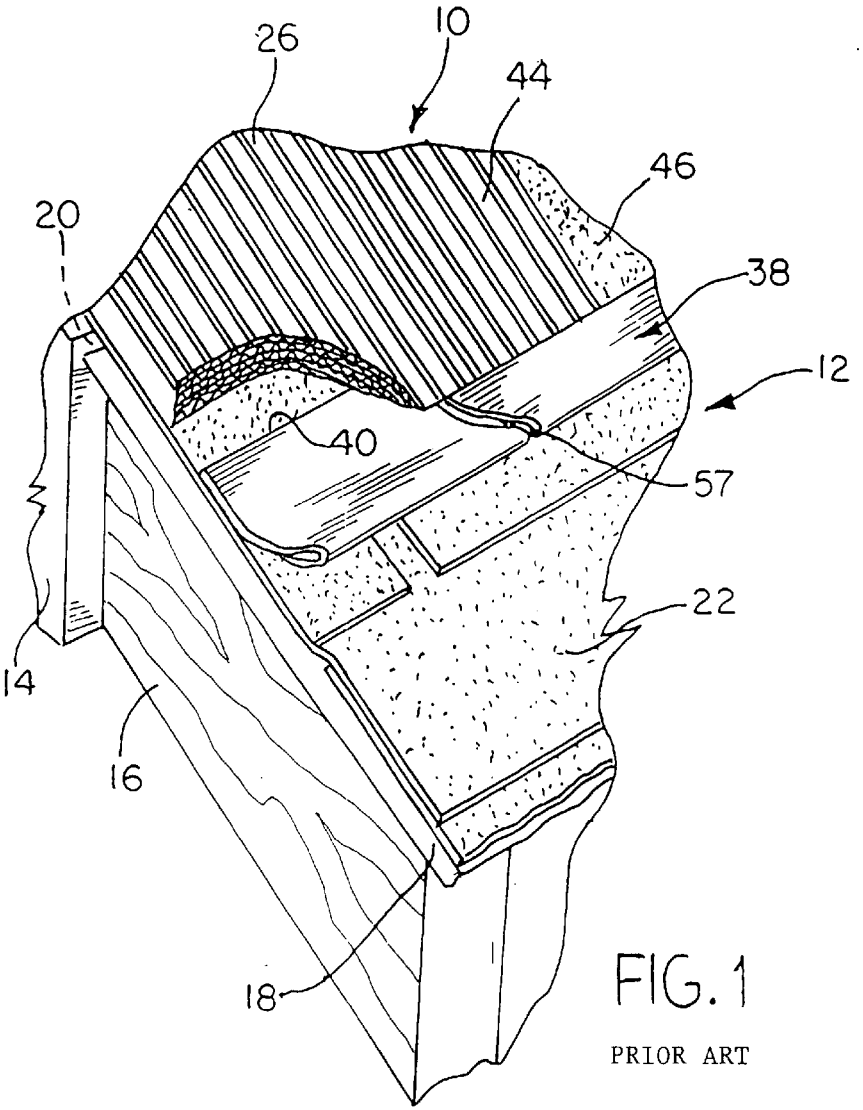
FIG. 1 PRIOR ART
FIG. 1 is a perspective view, partly in section, of a prior art ventilating device installed over a vent opening and a roof.
Figure 2:
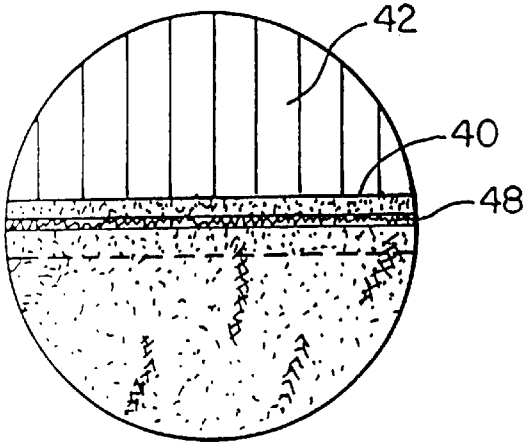
FIG. 2 PRIOR ART
FIG. 2 is an enlarged view of a small portion of the bottom of the ventilating device illustrated in the manner in which the flexible member is attached to the ventilating device.
Figure 1A:
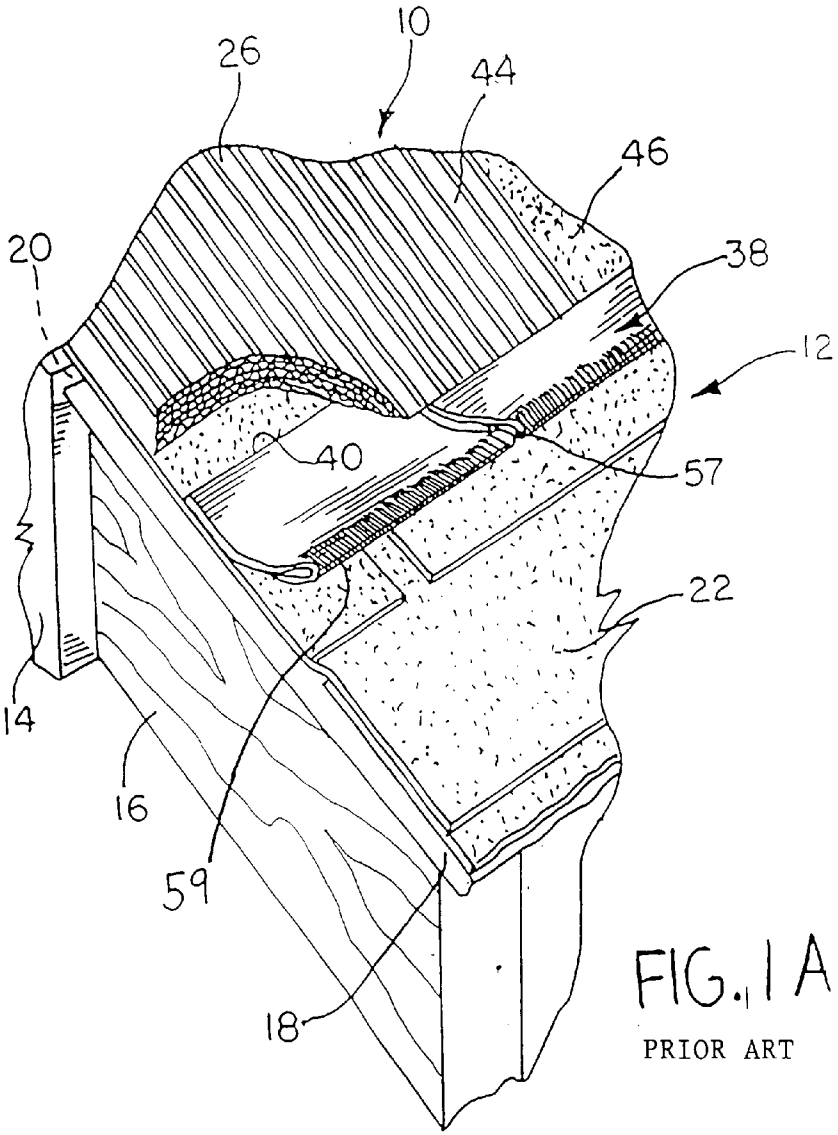
FIG. 1A PRIOR ART
FIG. 1A is a perspective view, partly in section, of a ventilating device including slits in the movable member installed over a vent opening and a roof.
Figure 3:
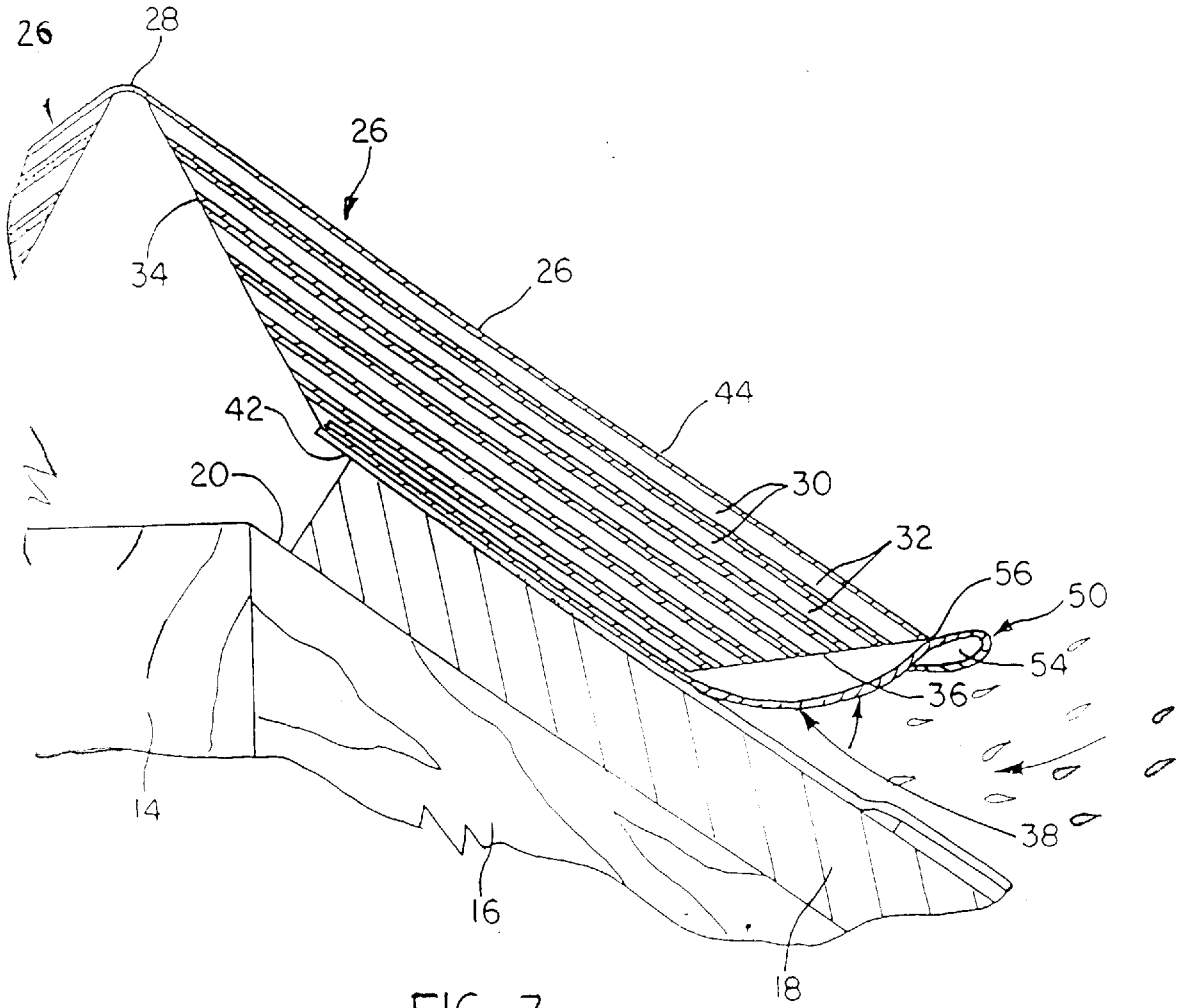
FIG. 3 PRIOR ART
FIG. 3 is a fragmentary cross-sectional view taken through the ventilating device and the roof illustrated in FIG. 1.
Figure 3A:
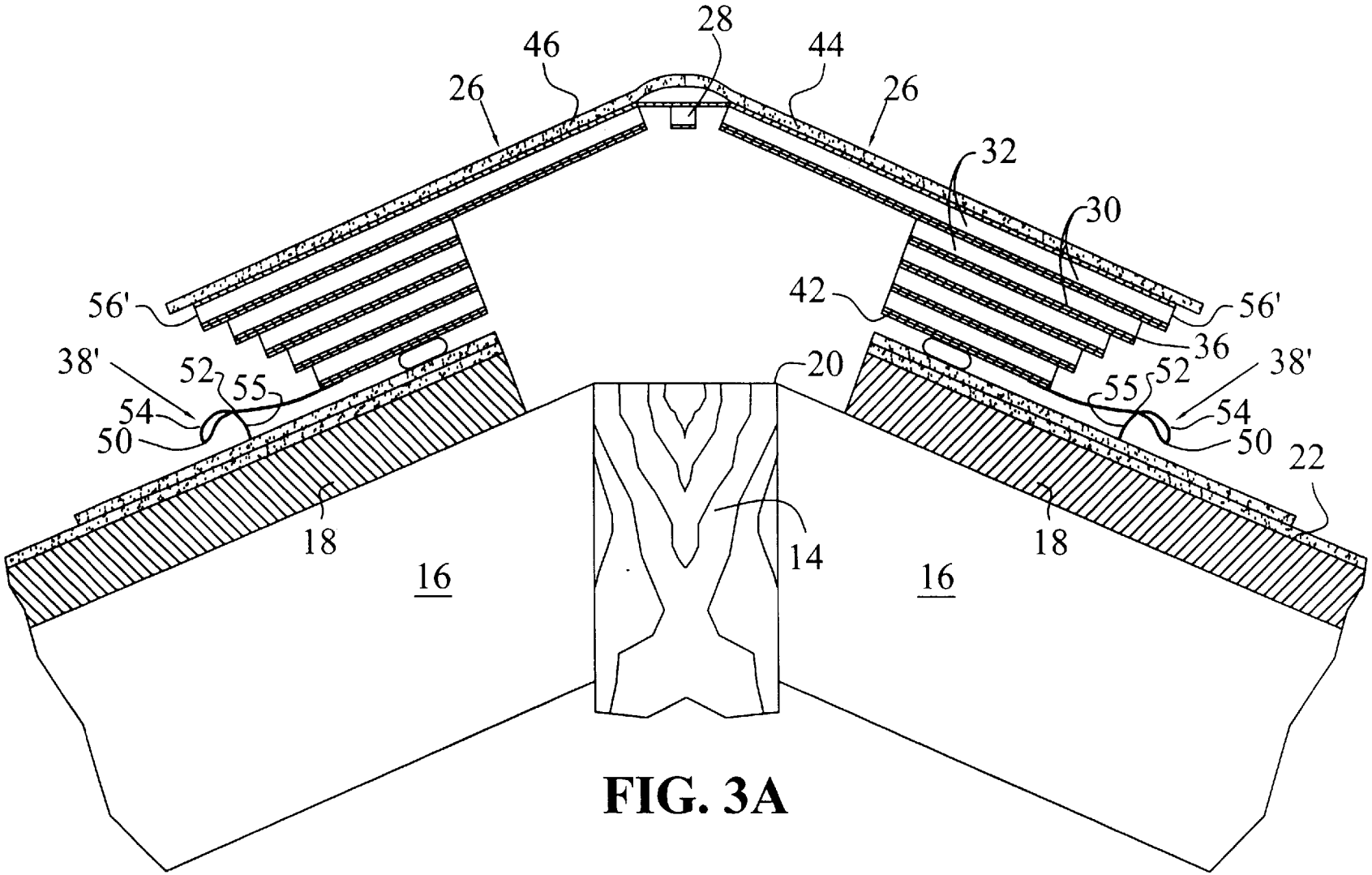
FIG. 3A is a fragmentary cross-sectional view taken through a ventilating device of the present invention showing the movable member having a lift spacer.
Figure 4:
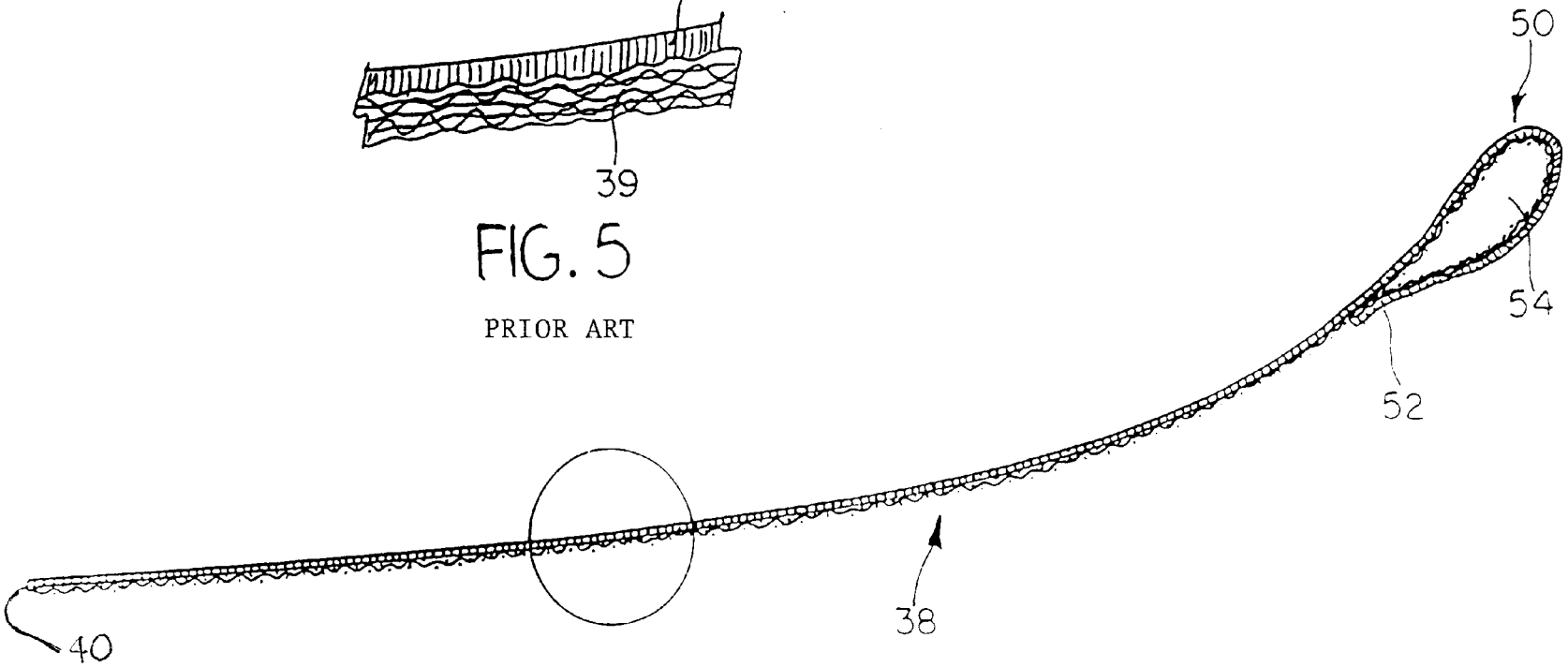
FIG. 4 PRIOR ART
FIG. 4 is a detailed view of the movable member of FIG. 3.
Figure 5:
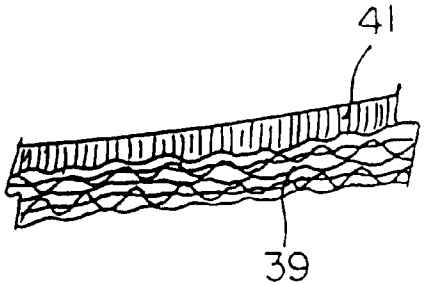
FIG. 5 PRIOR ART
FIG. 5 is an enlargement of the circumscribed portion of FIG. 4.
Figure 4A:
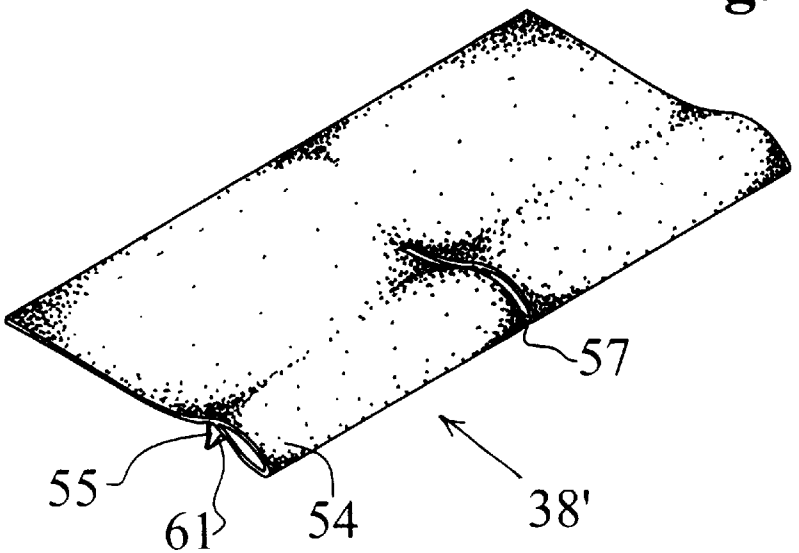
FIG. 4A is a perspective embodiment of the movable member of FIG. 3A having a lift spacer.
Figure 4B:
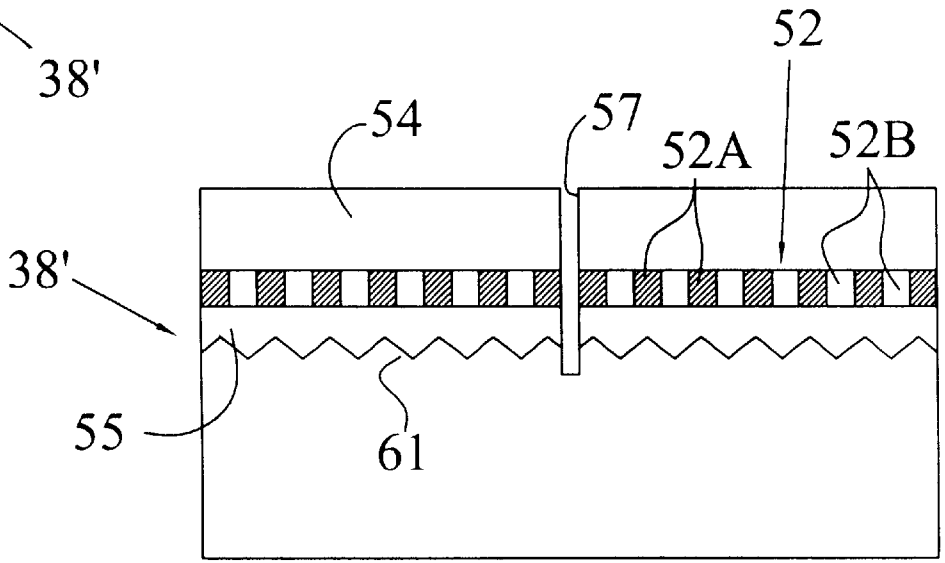
FIG. 4B is a bottom view of the movable member of FIG. 3A showing serrations on the end of the lift spacer.

The present invention incorporates FIGS. 1–5 of the prior art as described in detail above. In the present invention, the movable member is shown generally as 38' in FIGS. 3A, 4A, and 4B. As opposed to the movable member 38, which rests directly on shingles 22 when in the inactive position, movable member 38' includes a lift spacer 55 for raising the outer end 50 of movable member 38' off of shingles 22. In the embodiment shown, lift spacer 55 is made by extending the fabric of movable member 38' for a distance past seal 52. A crease along the bottom edge of seal 52 directs lift spacer 55 downward thereby providing a separation between the outer end 50 and shingles 22. Seal 52 may be made with sonic or heat welding or other well know techniques such as adhesives. It has been found that making seal 52 with non-continuous sealed portions 52*a* helps prevent warpage of movable member 38'. Intermittent non-sealed portions 52*b* are located between sealed portions 52*a*. In the preferred embodiment, lift spacer 55 includes serrations 61 along the distal edge which rests on shingles 22. Lift spacer 55 allows air to blow beneath movable member 38' to facilitate moving the movable member to a closed position at the desired wind speed. Serrations 61 also facilitate air moving to the rear portion of the movable member for providing air lift thereto and help prevent the movable member from becoming frozen to the shingles in cold weather.

In some areas that are susceptible to forest fires, the movable member may be provided with a fire resistant skin (such as aluminum foil) on the side of the movable member 38 that rests against the roof in the inactive position. Accordingly, when the movable member 38 is moved to the active position illustrated in FIG. 3 in response to ambient wind conditions, wind blown embers are deflected by the outer skin of the movable member 38.

Although the invention has been dealt with specific reference to the embodiment shown, someone skilled in the art work will recognize that changes can be made in form and detail without departing from the spirit and scope of the invention. The described embodiments are to considered in all respects only as illustrative and not restrictive. For example, the invention may be utilized with other embodiments of movable members disclosed in U.S. Pat. No. 6,213,868 and U.S. patent application Ser. No. 09,727,720. It should also be noted that a lift spacer may be used even if the movable member does not include a bubble 54. Also, the lift spacer may be used without the serrations or other configurations may be used at the distal edge of lift spacer 55 instead of serrations 61. Additionally, it should be noted that vent parts 26 in 3A show an alternate embodiment of the vent parts having a stepped outer edge leading up to corner 56'.

Also, although the lift spacer has been shown as being made from the same material as the moveable member, the lift spacer may be made be made from any suitable material such as plastic or metal as long as it provides spacing of the moveable member from the roof shingles or enhances movement of the moveable member from the inactive to active position. Such a lift spacer may be attached by any known conventional means such as adhesive or sewing. The lift spacer may also be attached to the roof instead of the moveable member so that the moveable member rests thereon. Of course, it should also be realized that the seal between the moveable member and the lift spacer need not be intermittent as provided in the embodiment shown. The scope of the invention is, therefore, indicated by the dependent claims rather than by the description.

What is claimed is:

1. A ventilating device for venting an opening in a building, said ventilation device comprising a vent member at least partially closing said opening and a movable member for closing the vent member, said movable member being responsive to wind speed at or in excess of a predetermined speed to deflect said movable member to an active position to prevent wind driven moisture from entering the opening, said movable member moving to an inactive position allowing air in the building to vent through the opening and out of the vent member when the wind speed is below the predetermined speed, said movable member including a lift spacer attached to said movable member and extending toward and contacting an outer roof surface of said building to provide a separation between an outer end of the movable member and the building when said movable member is in the inactive position.

2. The ventilation device as set forth in claim 1, wherein the movable member includes a bubble.

3. The ventilation device as set forth in claim 2, wherein the lift spacer is an extension of material used to form said bubble.

4. The ventilation device as set forth in claim 3, further comprising an intermittent seal between the lift spacer and the bubble.

5. The ventilation device as set forth in claim 4, wherein the vent member has a stepped outer edge.

6. The ventilation device as set forth in claim 1, wherein the movable member includes a kerf.

7. The ventilation device as set forth in claim 1, wherein the lift spacer has a serrated edge.

8. The ventilation device of claim 7, wherein said serrated edge contacts shingles on a roof of said building, when said movable member is in the inactive position.

9. A ventilating device for venting an opening in a building, said ventilation device comprising a vent member at least partially closing said opening; a movable member for closing the vent member, said movable member being responsive to wind speed at or in excess of a predetermined speed to deflect said movable member to an active position to prevent wind driven moisture from entering the opening, said movable member moving to an inactive position allowing air in the building to vent through the opening and out of the vent member when the wind speed is below the predetermined speed; and a spacer means attached to one of either said movable member or an outer roof surface of said building and extending therebetween to provide a physical separation between an outer end of said movable member and the building when said movable member is in the inactive position.

10. The ventilation device as set forth in claim 9, wherein the movable member includes a bubble.

11. The ventilation device as set forth in claim 10, wherein said spacer means includes an extension of material used to form said bubble.

12. The ventilation device as set forth in claim 11, wherein the movable member has a seal between said bubble and said spacer means.

13. The ventilation device as set forth in claim 12, wherein said seal is intermittent.

14. The ventilation device as set forth in claim 13, wherein said vent member has a stepped outer edge.

15. The ventilation device as set forth in claim 9, wherein said spacer means has a serrated distal edge.

16. The ventilation device as set forth in claim 15, wherein said serrated edge contacts shingles on a roof of said building when said movable member is in the inactive position.

17. The ventilation device as set forth in claim 16, wherein said movable member includes a kerf for increasing the flexibility thereof.

18. The ventilation device as set forth in claim 12, wherein said material is creased adjacent said seal disposing said extension at an angle to the main orientation of said movable member.

* * * * *